US010206524B2

(12) United States Patent
McPherson et al.

(10) Patent No.: US 10,206,524 B2
(45) Date of Patent: Feb. 19, 2019

(54) CHECKOUT TERMINAL

(71) Applicant: ASDA STORES LIMITED, Leeds (GB)

(72) Inventors: Samantha McPherson, Leeds (GB); Zoe Brough, Leeds (GB); Nazim Cheema, Leeds (GB); Paul Harrington, Leeds (GB); Sarah Lawson, Leeds (GB); Paul Dennis, Leeds (GB)

(73) Assignee: ASDA Stores Limited, Leeds (GB)

( * ) Notice: Subject to any disclaimer, the term of this patent is extended or adjusted under 35 U.S.C. 154(b) by 0 days.

(21) Appl. No.: 15/037,983

(22) PCT Filed: Nov. 19, 2014

(86) PCT No.: PCT/GB2014/053419
§ 371 (c)(1),
(2) Date: May 19, 2016

(87) PCT Pub. No.: WO2015/075444
PCT Pub. Date: May 28, 2015

(65) Prior Publication Data

US 2016/0270562 A1 Sep. 22, 2016

(30) Foreign Application Priority Data

Nov. 22, 2013 (GB) ..... 1320612.3

(51) Int. Cl.
*A47F 10/02* (2006.01)
*A47F 9/04* (2006.01)

(52) U.S. Cl.
CPC ..... *A47F 9/048* (2013.01); *A47F 9/04* (2013.01)

(58) Field of Classification Search
CPC ..... A47F 9/046; A47F 10/02; B65G 37/00; B65G 47/42; B65G 40/00; B65G 47/8834
See application file for complete search history.

(56) References Cited

U.S. PATENT DOCUMENTS

2006/0076406 A1* 4/2006 Ulrich ..... A47F 9/046 235/383
2013/0062159 A1* 3/2013 Fischer ..... A47F 9/048 198/367

(Continued)

FOREIGN PATENT DOCUMENTS

EP 2177135 A1 4/2010
EP 2472432 A1 7/2012

(Continued)

OTHER PUBLICATIONS

Written Opinion and International Search Report for International Application No. PCT/GB2014/053419, dated Feb. 20, 2015 (9 pages).

(Continued)

*Primary Examiner* — Mark J Beauchaine
(74) *Attorney, Agent, or Firm* — McCarter & English, LLP; David R. Burns

(57) ABSTRACT

A checkout terminal for customers in a retail store. The terminal provides a path for products from a loading conveyor section, via a scanning section and a common transfer conveyor section, to reach a respective one of a plurality of plurality of packing stations to be bagged or packed by or for the customer. Conveniently, three of these packing stations are arranged substantially parallel to each other. Each packing station may be associated with a corresponding payment interface. Customer throughput is increased by providing multiple packing areas associated with one loading and scanning area, and customer convenience is improved by the (Continued)

faster and more efficient configuration of the checkout terminal.

20 Claims, 7 Drawing Sheets

(56) References Cited

U.S. PATENT DOCUMENTS

| | | | | |
|---|---|---|---|---|
| 2014/0353115 | A1* | 12/2014 | Baitz | A47F 9/047 198/340 |
| 2015/0194023 | A1* | 7/2015 | Brackenridge | G06Q 30/06 235/380 |

FOREIGN PATENT DOCUMENTS

| | | | |
|---|---|---|---|
| JP | H07141553 | A | 6/1995 |
| WO | 20130120875 | A2 | 4/2013 |
| WO | 2013120875 | A3 | 10/2013 |

OTHER PUBLICATIONS

Office Action from related Japanese patent application No. JP 2016-554925 dated May 15, 2018. (3 pages).

* cited by examiner

CHECKOUT TERMINAL

CROSS-REFERENCE TO RELATED PATENT APPLICATIONS

This application is a 35 U.S.C. § 371 National Stage filing of International Application No. PCT/GB2014/053419, filed on Nov. 19, 2014, which claims priority to GB Application No. 1320612.3 filed on Nov. 22, 2013, the content of each application is hereby incorporated by reference in its entirety.

BACKGROUND

Technical Field

The present invention relates generally to the field of checkout terminals. More particularly, the present invention relates to a checkout terminal that may be used by a customer to pay for goods in a retail store.

Description of Related Art

Generally, there is a desire to increase throughput within a retail store, by allowing customers to pay for goods at a check-out terminal quickly and efficiently. Each retail store has a finite total store area, and at busy times the store may reach a saturation point of its capacity to handle customers. This may cause long delays, which is inconvenient for the customer.

Conversely, increasing the throughput capacity of check-out terminals within a retail store allows a checkout zone to be made smaller for a certain throughput, which has economic and environmental benefits by allowing the store to be smaller in total area. Also, increasing throughput allows the checkout zone to be made smaller in order to release floor area of the store for other purposes such as displaying goods or offering other services.

In the related art, it is known to provide a checkout terminal which is used by the customer themselves to pay for goods in a retail store. Typically, such a checkout terminal includes a scanning station where the customer scans their goods, a loading station where the customer loads their goods toward the scanner, and a bagging station where the customer packs their goods after scanning. A wide variety of checkout terminals have been developed, but further improvements are still desired. In particular, a checkout terminal is desired which is capable for use by customers who have many items in a large trolley.

The example embodiments have been provided with a view to addressing at least some of the difficulties that are encountered currently, whether those difficulties have been specifically mentioned herein, or will otherwise be appreciated from the discussion herein, such as by carrying out example embodiments.

SUMMARY OF THE INVENTION

According to the present invention there is provided a checkout terminal as set forth in the appended claims. Other, optional, features of the invention will be apparent from the dependent claims, and the description which follows.

There now follows a summary of various aspects and advantages according to embodiments of the invention. This summary is provided as an introduction to assist those skilled in the art to more rapidly assimilate the detailed discussion herein and is not intended in any way to limit the scope of the claims that are appended hereto.

In one example there is provided a checkout terminal for use by customers in a retail store. The terminal provides a generally U-shaped path for products from a loading conveyor section, via a scanning section and a common transfer conveyor section, to reach a respective one of a plurality of plurality of packing stations to be bagged or packed by the customer. Conveniently, three of these packing stations are arranged substantially parallel to each other. Each packing station may be associated with a corresponding payment interface. Customer throughput is increased by providing multiple packing areas associated with one loading and scanning area, while maintaining a smooth lateral transition between the loading section to each of the multiple packing stations.

In one example there is described a checkout terminal, comprising: a loading conveyor section arranged to receive and convey product items which are loaded by a customer; a scanning section arranged to scan the product items conveyed by the loading conveyor section; a transfer conveyor section arranged to transfer the product items after scanning by the scanning section; and a plurality of packing stations each arranged to selectively receive product items from the transfer conveyor section, ready to be packed by the customer; wherein the loading conveyor section and the transfer conveyor section form a delivery path of the product items with each of the plurality of packing stations, respectively.

In one example, at least one of the loading conveyor section, the transfer conveyor section and the packing stations is formed as a modular furniture item.

In one example, the transfer conveyor section is arranged transversely. the transfer conveyor section may be substantially perpendicular to the loading section and to each of the packing stations. In one example, the checkout terminal may provide a generally U-shaped delivery path. In one example, the delivery path may be S shaped. In one example, the packing stations are arranged substantially parallel to each other, and may be spaced apart from each other. A gap may be provided between a respective pair of the packing stations. In one example, a pair of the packing stations may be provided adjacent one another in a back to back configuration.

In one example, the packing stations are arranged in a row, each packing station being fed in common by the transfer conveyor section. In one example, the loading conveyor section is arranged to transport the product items along a substantially linear path in a lengthwise direction of the loading conveyor section. In one example, the transfer conveyor section is arranged to transport the product items along a substantially linear path in a lengthwise direction of the transfer conveyor section.

In one example, the terminal includes a product diversion unit arranged to selectively divert the product items from the transfer conveyor section into a respective one of the plurality of packing stations. In one example, the product diversion unit comprises at least one diverter arranged to selectively divert product items from the transfer conveyor section into the respective packing station according to a product diversion route set for the customer. In one example, the diverter comprises an arm which is rotatably mounted to extend selectively in use across the transfer conveyor section.

In one example, the plurality of packing stations comprise at least first, second and third packing stations, and wherein the terminal further comprises a first diverter configured to selectively divert products into the first packing station when the first packing station is allocated to the customer or else to allow the product items to continue along the transfer conveyor section, and a second diverter configured to selectively divert products into the second packing station when the second packing station is allocated to the customer or else to allow the product items to continue along the transfer conveyor section, wherein the first and second diverters are configured to allow the product items to reach the third packing station along the transfer conveyor section when the third packing station is allocated to the customer.

In one example, the terminal includes an end buffer positioned to direct product items at a distal end of the transfer conveyor section into a last one of the packing stations.

In one example, the terminal includes an entry buffer positioned to direct product items from the loading conveyor section onto the transfer conveyor section.

In one example, at least one of the loading conveyor section and the transfer conveyor section comprises a conveyor belt. In one example, at least one of the packing stations comprises a conveyor to propel the product items therealong. In one example, at least one of the packing stations comprises a conveyor belt.

In one example, the scanning section comprises a bar-code scanner. The scanning section is suitably arranged to identify the products loaded by the customer onto the loading conveyor section. The scanner may pass information about the products to a point-of-sale system in a retail store.

In one example, the terminal includes a payment interface to receive payments from the customer. The payments may be controlled by the point-of-sale system according to the products identified by the scanner. In one example, each said packing station is associated with a corresponding payment interface located at or near to the respective packing station.

In one example, the terminal includes a customer interface unit located adjacent to the loading conveyor section. In one example, the customer interface unit is arranged to receive a user input from the customer to activate the terminal ready for use by the customer. In one example, the terminal is arranged to allocate a currently vacant one of the packing sections to the customer upon receiving an activation signal from a user interface unit located adjacent to the loading conveyor section.

In one example, the terminal is arranged to allocate the loading section to the customer until the terminal determines that loading of product items is finished, and then to release the loading section for use by another customer. In one example, the terminal is arranged to release the currently allocated packing section after receiving a payment from the customer for the product items.

In one example there is described a method of operating a checkout terminal, comprising: activating the terminal ready to be used by a current customer; configuring a product diversion mechanism to construct a product diversion route which reaches a selected one of a plurality of packing stations from a loading conveyor section via a transfer conveyor section; receiving one or more products which are loaded onto the checkout terminal by the customer; scanning the products by a scanner located on the product diversion route; moving the products of the customer along the product diversion route until all of the loaded products have been transferred to the selected packing station; and reconfiguring the product diversion mechanism so that subsequent products of a next customer are routed to another of the plurality of packing stations.

In one example the method includes releasing the loading conveyor section of the checkout terminal to be used by the next customer, after the product items of the current customer have left the loading conveyor section.

In one example the method includes monitoring packing of the products by the customer in the selected packing station, until packing of the products is completed, and then releasing the packing station ready to be used by another customer.

In one example the method includes constructing the product diversion route in generally a U-shape when the checkout terminal is viewed from above in a plan view.

BRIEF DESCRIPTION OF THE DRAWINGS

For a better understanding of the invention, and to show how example embodiments may be carried into effect, reference will now be made to the accompanying drawings in which.

DETAILED DESCRIPTION OF THE EXAMPLE EMBODIMENTS

At least some of the following example embodiments provide an improved checkout terminal. Advantageously, the example embodiments may help to increase customer throughput for a given floor area within a retail store, giving many operational and environmental benefits. Many other advantages and improvements will be discussed in more detail herein.

Figure 1:
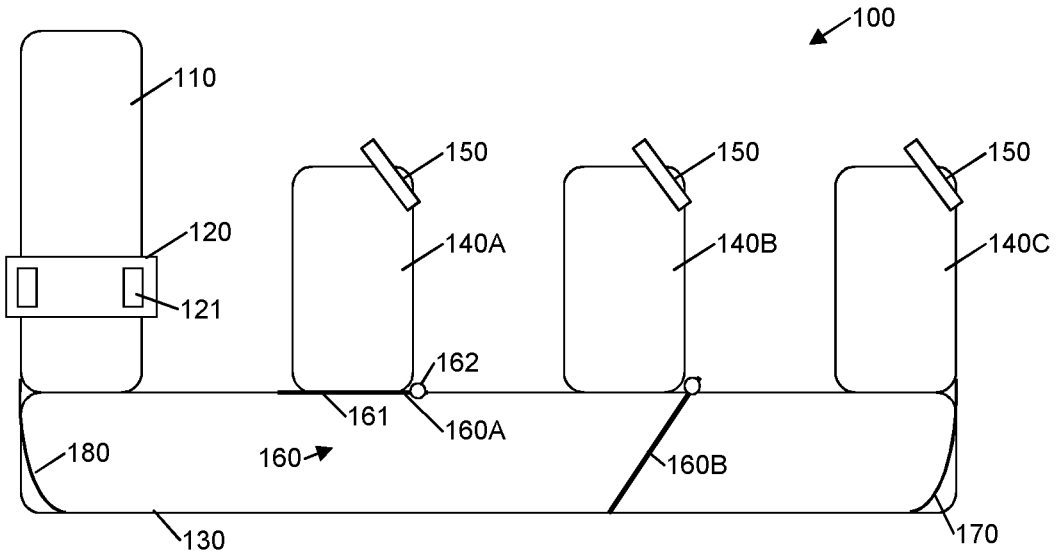
FIG. 1 is a schematic view of an example checkout terminal.

FIG. 1 is a plan view of an example checkout terminal 100. In one example, the terminal 100 may include a loading section 110, a transfer conveyor section 130, and a plurality of packing stations 140. The example checkout terminal 100 may further include a scanner 120.

The loading section 110 is arranged to receive and convey product items which the customer desires to purchase. The scanning section 120 includes a scanner 121 to scan the product items, such as a bar-code scanner. The scanner 121 may be linked to a point of sale (POS) system in the store, as will be familiar to those skilled in the art.

The transfer conveyor section 130 is arranged to transfer the product items after scanning by the scanner 121. The packing stations 140 are each arranged to receive product items from the transfer conveyor section 130, ready to be bagged or packed by the customer. Conveniently, these packing stations 140 are arranged substantially parallel to each other. The packing stations may be aligned in a row, each being fed in common by the transfer conveyor 130. In this example, three such packing stations 140A, 140B, 140C are shown. In one example, each packing station 140 may be associated with a corresponding payment interface 150.

The or each conveyor section may have any suitable construction as will be familiar to those skilled in the art, being arranged to mechanically propel the products along a lengthwise axis of that section. In one example, the loading conveyor section 110 and the transfer conveyor section 130 may be formed using one or more conveyor belts. However, other conveyor technologies may also be used, as will be appreciated by those skilled in the art. For example, the conveyor sections may be formed using a plurality of rollers, rather than a moving belt. Conveniently, each conveyor section conveys product items along a substantially linear path in one direction. However, in another example embodiment, a curvilinear path may be implemented. The conveyor may be constructed to convey the products along a curved path. Curvilinear conveyors are useful in constricted spaces, e.g. to avoid an obstacle such as column in a store.

A product diversion unit 160 is provided to divert products from the transfer conveyor 130 to a respective one of the plurality of packing stations 140. In one example, the product diversion unit 160 is arranged to selectively divert the products from the transfer conveyor 130 into one particular packing station 140 at a respective period in time.

In the example embodiment, the product diversion unit 160 includes a first product diversion mechanism 160A which is associated with a first packing station 140A. In one example, the first packing diversion mechanism 160A comprises an arm member 161 rotatably mounted to a mounting fixture 162, such as a post. The arm 161 is controlled to be moveable between an open position lying across the transfer conveyor 130 which directs products into the respective packing station, and a closed position which directs products on the transfer conveyor 130 to move past the respective packing station without entering the packing station 140. In this way, the first product diversion mechanism 160A either selectively captures products from the transfer conveyor 130 and directs those products towards the first packing station 140 when in the first configuration, or else allows the products on the transfer conveyor 130 to move beyond the first packing station 140 when in the second configuration. In this example, the first configuration is thus an interference position which actively interferes with the flow of products, and the other configuration is a non-interference position which passively allows products to continue along the conveyor.

As shown in FIG. 1, a second product diversion mechanism 160B is provided to selectively divert products from the transfer conveyor 130 into the second packing station 140B. The first and second product diversion mechanisms may have a similar construction. The first and second product diversion mechanisms 16A, 160B may be constructed in the form of gates which together selectively define a desired route for each product. In this example, products which reach a distal end of the conveyor 130 are diverted into the last packing station 140C. An end buffer 170 may be provided to direct products from the transfer conveyor 130 into the last packing station 140C. The end buffer 170 may be fixedly located. An entry buffer 180 may also be provided which guides and redirects products from the loading conveyor 110 onto the transfer conveyor 130. Any suitable mechanism may be provided to maintain movement of the products between the sections, as will be familiar to those skilled in the art.

Conveniently, the terminal 100 shown in FIG. 1 comprises a plurality of modular furniture sections. Each section may be readily replaceable and changeable individually for ease of construction and maintenance. Each modular furniture section is suitable arranged to be mechanically coupled to a neighboring section. Thus, a mechanical connector may be provided which maintains a fixed spatial relationship between the neighboring sections in use. One or more electrical connectors may also be provided, suitable to carry control signalling and/or electrical power from one section to another. The sections may be manufactured individually in advance. A relevant group of sections may be gathered together, e.g. by being delivered to a retail store, and may be coupled together on site in an installation phase. The sections may later be released or uncoupled from each other. In one example, the configuration of the terminal is readily changed, by uncoupling one or more sections and then coupling the sections together again in different positions or orientations, or by replacing one section with another section of the same or different type. The terminal may be constructed so that multiple different configurations are readily achieved. For example, the transfer conveyor section 130 may provide multiple coupling positions each of which is suitable to receive another section. In use, certain of the coupling positions are then occupied by other sections. The number of coupling positions may be greater than the number of sections to be coupled, such that in use one or more of the coupling sections will remain unoccupied. In this way, a flexible modular terminal is readily constructed and arranged according to the particular needs of a certain site. Also, the configuration may be readily adapted or changed on site.

Suitably, the loading conveyor section 110 forms a first furniture section, and each of the packing stations 140 comprises its own furniture section. The transfer conveyor 130 may comprise one single furniture section, or may be sub-divided into a plurality of transfer conveyor furniture sections which are linearly arranged as needed to provide a desired length of the transfer conveyor. In one example, the transfer conveyor 130 may comprise two or more individual conveyor belts. It is envisaged that a fourth or a fifth packing station 140 could be added by appropriately extending the transfer conveyor section 130 and adding further such packing stations 140.

The packing stations 140 may have any suitable construction as will be generally familiar to those skilled in the art, allowing customers to obtain and pack their goods locally at that packing station. In the example embodiment, each of the packing stations 140 comprises a motorised packing conveyor which moves products at least away from a junction region with the transfer conveyor 130 onto the packing station 140. Thus, each packing station 140 suitably comprises a motorised conveyor, such as a conveyor belt, extending at least part way along the lengthwise direction of the packing station. The packing station 140 may have an area to receive the product items from the conveyor, ready to be packed by or for the customer.

Figure 2:
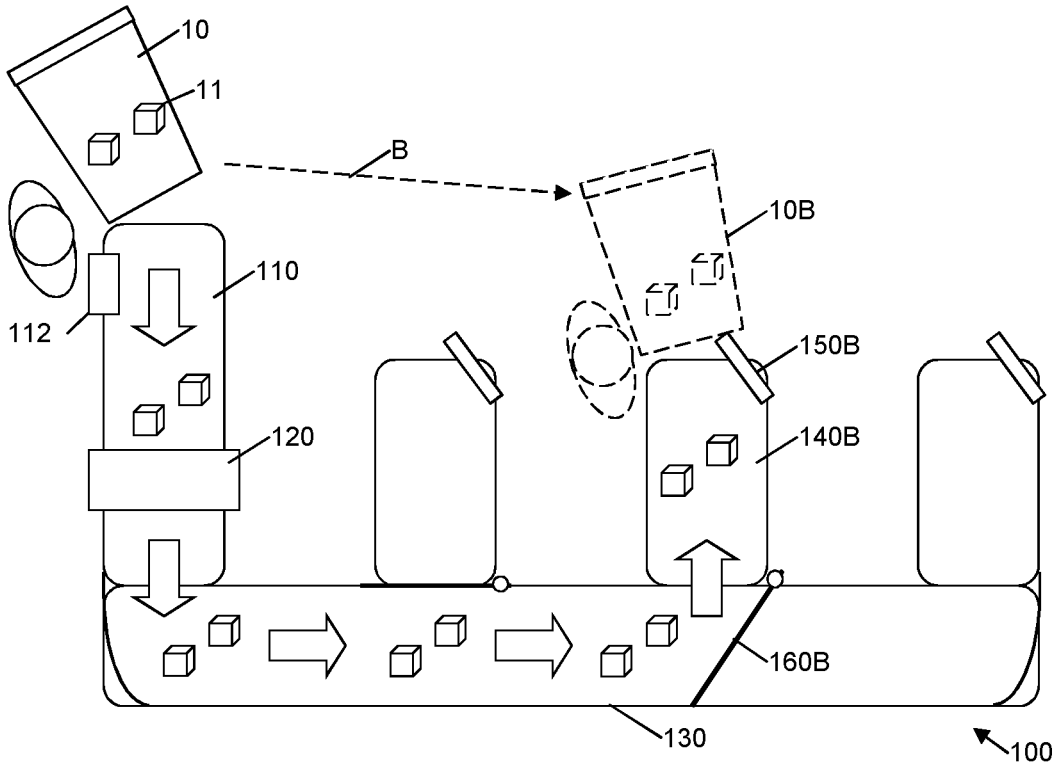
FIG. 2 is a further schematic view of the checkout terminal.

FIG. 2 shows the example checkout terminal 100 in more detail during use. The loading conveyor section 110 is designed to be approached by a customer having products 11 in a suitable carrier 10, such as a wheeled trolley. Conveniently, the loading conveyor section 110 comprises a user interface unit 112 which receives a user input to activate the checkout terminal 100. For example, the user interface 112 comprises a touch screen display panel and the user presses a virtual button on the display screen to begin a new checkout process. As another example, the user interface 112 may include a card reader and the terminal 100 is activated by the user presenting a store loyalty card, (e.g. a magnetic stripe card or a chip and pin card). In still further examples, the user interface 112 may include an RFID station or other contactless transmitter which reads an appropriate RFID tag or other tag device (e.g. a mobile phone) carried by the user. Still further activation options will be apparent to those skilled in the art which are appropriate for use at the user interface section 112.

In this example, the loading conveyor section 110 carries and transports the products 11 through the scanner 120, after the products 11 are loaded from the carrier 10 onto the loading conveyor section 110, e.g. by the customer or on their behalf. Conveniently, the scanner 120 is formed as an arch or bridge configuration over the conveyor 110 as discussed in more detail below. Notably, such a construction allows for rapid, accurate and reliable scanning of the products. In use, the products 11 may exit the scanner station 120 and are passed to the transfer conveyor section 130, with assistance in the example embodiment from the entry buffer 180. The transfer conveyor 130 then transports the products along a substantially linear path (or curvilinear path) to a respective one of the plurality of packing stations 140. In this example, the products are carried to the second packing station 140B. Conveniently, a message is displayed on the user interface 112 informing the customer of the allocated packing station. Hence, after loading all of their products, the customer may transition to the allocated packing station 140.

As shown by arrow B in FIG. 2, the customer conveniently makes a lateral transition from the loading position in relation to the loading conveyor section 110 to then stand in a packing position adjacent to the respective packing station 140. The customer may now pack their products from the packing station, into their carrier or trolley 10. Typically, bags are provided by the retail store or are introduced by the customer for transporting their products out of the carrier or trolley 10 and away from the retail store. Hence, the packing station 140 may also be termed a bagging station.

When loading of the products is complete, the customer suitably informs the user interface 112 in any suitable manner. For example, the customer presses a virtual button on a touch screen display to indicate that loading is "finished". The customer may then transition to the respective packing section 140 while any remaining products are being scanned and transported. Conveniently, the terminal 100 monitors progress of the products loaded by the customer until all of the loaded products have been delivered to the respective packing station 140B along the transfer conveyor 130 via the scanning station 120. In one example, the transfer speed of the loading conveyor and the transfer conveyor is known and thus it is readily predictable that products loaded by the customer will reach the respective packing station within a determined time. When this time has expired, then the system may consider that all of the customer's products will have reached the relevant packing station and may then release the loading station 110 ready to be used by a next customer. Conveniently, the product diversion mechanism 160 then rearranges the product diversion route so that the products of the next customer will be transferred instead to another of the packing stations, such as the first packing station 140A or the last packing station 140C. In the example embodiment, the diverter gate 160B moves to the closed position after the last products of the current customer have been delivered into the respective packing station 140B. The next customer is then, for example, allocated to the first packing station 140A and thus the first gate diverter 160A now moves to the open position ready to divert the products of the next customer to that packing station.

Optionally, the terminal 100 may be configured to actively monitor progress of products along the transfer path. For example, a divider tag or bar may be introduced which signifies the separation of products for one customer and the next. As another example, a last product of the customer may be monitored using a series of product scanning elements, such as a series of separate bar code scanning elements. As another example, a light beam detector may be provided at an entry junction with the relevant packing station which monitors for arrival of products in the relevant packing station. Thus, the system may actively determine that all of the customer products have arrived at the desired packing station.

Looking again at FIG. 2, the customer at the second packing station 140B may complete a checkout process by making a payment using the payment interface 150B associated with this packing station. The payment interface 150B may take any suitable form as will be familiar to those skilled in the art for making payments. The payment interface 150 may be configured to perform cash payments, card payments, mobile credit payments, contactless payments or similar. The customer may then leave the checkout terminal 100 with their products after completing the payment process, releasing the respective packing station 140 ready to be used by another customer. In this example, the checkout terminal 100 may be configured as a self-checkout terminal which is intended to be used and operated by customers.

Notably, the example checkout terminal 100 allows multiple customers to be actively using the terminal at the same time, with each customers suitably being in one of the respective phases of the checkout procedure. For example, a first customer may use one of the packing stations 140 whilst a second customer starts to use the loading station 110, and so on. As a result, customer throughput is improved. Further, the terminal 100 is constructed so that the customer is able to move easily and conveniently from one station to another, i.e. from the loading station to one of the payment stations, and from the payment station towards an exit, in co-ordination with other customers who are also using the same terminal. Hence, each customer is able to progress through the checkout at their own pace whilst co-ordinating their movements with those of other customers. Surprisingly, it has been found that a generally U-shaped construction can be beneficial to customer throughput using the terminal. Also, the overall footprint of the terminal is relatively compact. Further, the checkout terminal is versatile and can be adapted to fit the specific requirements of each location.

The scanning station 120 may be provided at any suitable location along the transfer path of the products. In this example, a scanning station 120 is provided as a bridge or arch construction over the loading conveyor section 110. However, it is also envisaged that, in other embodiments, the scanning section 120 could be placed over the transfer section 130, if desired. However, placing the scanning section 120 relatively close to the loading position and nearby to the user interface 112, allows any products which fail the scanning process to be retrieved and rescanned. Conveniently, an operator may supervise the checkout terminal 100. The user interface 112 may selectively operate as an operator interface for the operator, such as when rescanning products, or to confirm the sale of products, (e.g. alcohol) with an age limit. Conveniently, one operator may supervise the checkout terminal which is being used by a number of customers simultaneously, or may even supervise many adjacent checkout terminals.

Figure 3:
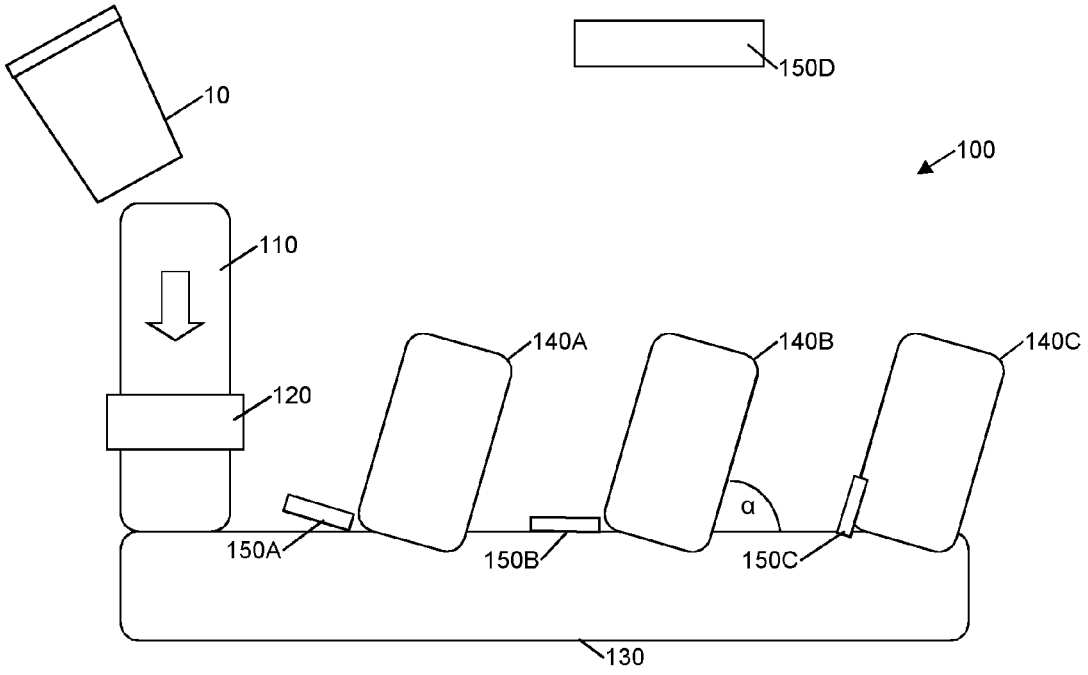
FIG. 3 is a further schematic view of an example checkout terminal.

FIG. 3 shows another example in which the packing stations 140 are each parallel with one another but in this case are not perpendicular to the transfer conveyor 130. In this example, each of the packing stations 140 is offset by an angle $\alpha$ with respect to the longitudinal axis of the transfer conveyor 130. The angle $\alpha$ may be an obtuse angle or, conveniently, may be an acute angle. Thus, as illustrated by the embodiment of FIG. 3, further variations of the exact size and position of the furniture sections of the checkout terminal are possible whilst still conforming to the principles and teachings discussed herein.

Figure 4:
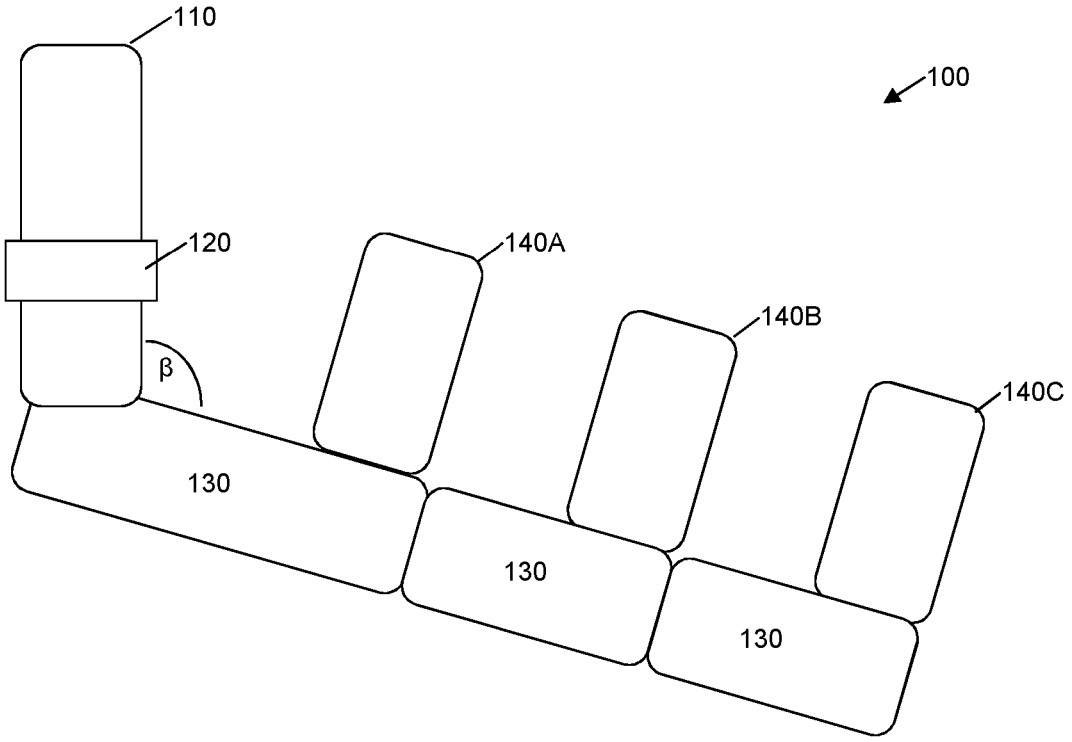
FIG. 4 is a further schematic view of an example checkout terminal.

FIG. 4 shows a further example wherein the packing stations 140 are each parallel to each other in a spaced apart relation and in this example are perpendicular to the transfer conveyor 130, while the loading station 110 is offset, being neither perpendicular with or parallel to the other components. In this example, a generally U-shaped configuration is still achieved. The loading station 110 in this case is offset at an angle β with respect to the longitudinal axis of the transfer conveyor 130. The angle β may be an oblique angle. The angle β may be an acute angle or, conveniently, may be an obtuse angle.

In a still further example, the packing stations 140 could be arranged at any suitable position around the transfer conveyor 130. In one example, the packing stations 140 could be provided on either the left or the right hand side of the illustrated transfer conveyor 130, relative to the direction of travel of the conveyor. In another example, it is envisaged that first and second banks of packing stations 140 could be provided to either side of the transfer conveyor 130, respectively.

Figure 5:
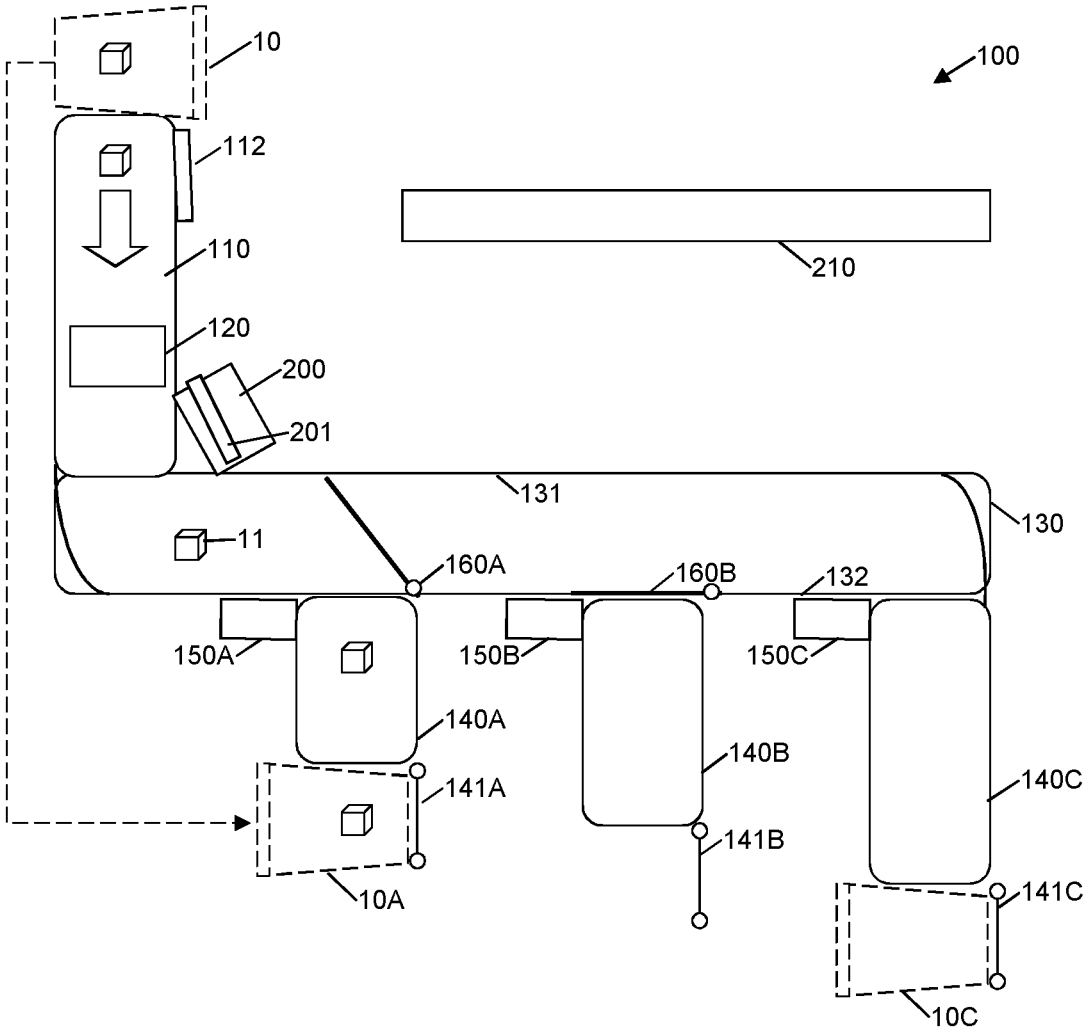
FIG. 5 is a further schematic view of an example checkout terminal.

FIG. 5 is a further schematic view of an example embodiment of the checkout terminal 100 described herein. In this example, the loading station 110 and the packing stations 140 are disposed on opposing sides of the transfer conveyor section 130. In use, the product items 11 may pass from the loading station 110 onto a first side 131 of the transfer conveyor section 130 and may exit from another second side 132 of the transfer conveyor section 130 onto a respective one of the packing stations 140. The products 11 may exit from the transfer conveyor section 130 and may be guided by the product diversion mechanism 160, such as the illustrated rotatable arms 160A, 160B.

In this example, the checkout terminal 100 may be associated with an operator console 200. The operator console 200 may be provided for a member of staff who supervises the checkout terminal 100. The operator console 200 may include a suitable user interface module 201, such as a screen and keyboard, a touch screen, card reader and so on. The operator console 200 may be conveniently provided at or adjacent to the first side 131 of the transport conveyor 130. The operator console 200 may be placed at a junction between the transfer conveyor 130 and the loading conveyor 110 so that the operator has easy access to these sections of the checkout terminal 100.

In one example, the operator console 200 may further include an operator payment interface 151 which is operable by the operator or supervisor of the checkout terminal 100. In one example, the checkout terminal 100 may be operated as a manned checkout, wherein the operator is present in use and processes goods through the checkout terminal, including operating the checkout and the payment interface 151. In another example, the checkout terminal 100 is configured as a self-checkout which is operated primarily by the customer.

In one example, the checkout terminal 100 is readily adapted and may be configured at some times as a self-checkout and at other times as a manned checkout, giving further versatility and flexibility. The checkout terminal may be adaptably configured during installation, and is subsequently operated in one desired mode. In another example, the checkout is dual-purpose and may be selectively operated in either the operator mode or the self-checkout mode as needed during opening hours of the retail store.

In one example, the checkout terminal may be adapted between a self-checkout configuration and an operator checkout configuration by changing the loading section 110. As noted above, the modular design of the terminal allows one design or form of the loading section 110 to be readily replaced by another design or form of the loading section 110.

In use, as discussed above, the customer may position their trolley 10 adjacent to the loading section 110 and unload their products 11 from the trolley 10. The products may transferred to the respective packing station 140A, 140B or 140C and the customer may transition to the respective station, including placing their trolley such as in a position 10A or 10C as illustrated with dotted lines. The packing stations 140 may be associated with one or more trolley parking guides 141. In this example, each packing station 140A-140C is associated with a respective trolley guide 141A-141C which allows the trolley 10 to rest in a desired position adjacent to the packing station 140 while being filled with the purchased product items. In one example, other furniture items 210 such as a merchandising display may be located alongside the checkout terminal 100, particularly in order to guide customers toward the loading conveyor 110.

Figure 6:
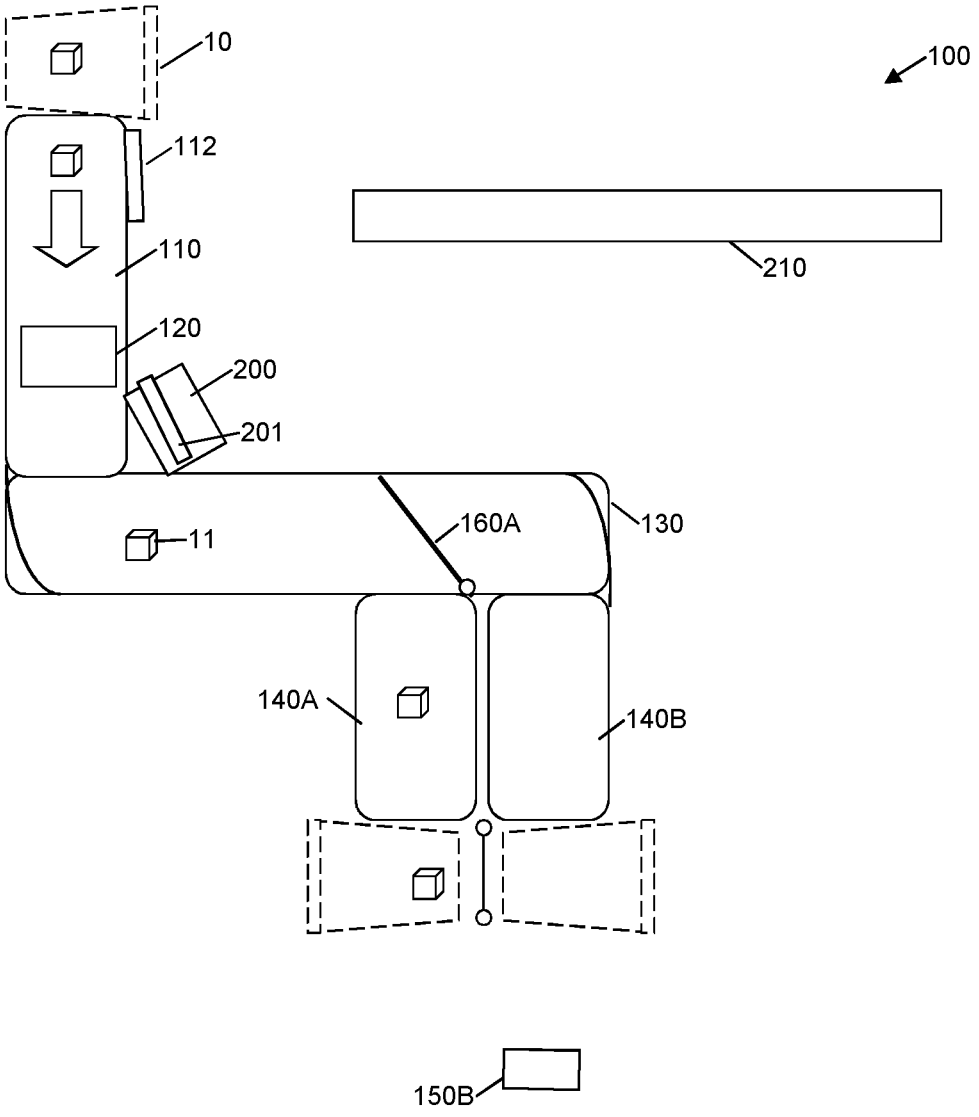
FIG. 6 is a further schematic view of an example checkout terminal.

FIG. 6 shows a further example embodiment of the checkout terminal 100, having the components already described herein. In this example, two of the packing stations 140 may be arranged adjacent to each other in a back to back configuration. In this example, the two packing stations 140*a*, 140*b* are accessible from opposing sides. In one example, the modular construction of the terminal 100 allows the sections to be arranged, and re-arranged, as needed, in relation to each other. Thus, it is envisaged that the checkout terminal 100 may be arranged in use having one pair of sections which have a spaced apart relation and another pair in an adjacent relation.

In any of the examples as discussed herein, the payment station 150 may be provided at any suitable location in or around the checkout terminal 100. For example, it is possible for the payment interface 150 to be provided adjacent to the transfer conveyor 130, or in a region near to a junction region or corner region between the transfer conveyor 130 and the packing station 140, as illustrated in FIG. 3 or FIG. 5.

It will be appreciated that FIG. 3 also shows a further example arrangement in which the payment station 150D is, additionally or alternately, separated from the packing stations 140 and provided in a central position to be usable by customers from each of the packing stations 140A-140C. However, providing individual payment stations 150A-150C each associated with the respective packing station 140A-140C, allows the customer to stay in the packing position even while any difficulties with payment are resolved, if necessary with help from the operator or supervisor personnel of the retail store.

In the example embodiments, the packing stations 140 are all fed in common by the transfer conveyor 130. In one example, the products 11 may follow a generally U-shaped path from the loading station 100 to the packing station 140. In another example, the products 11 may be transferred along a generally S-shaped path.

In one example, a checkout terminal is provided which is well suited for use by customers having many items in a large trolley. Typically, a trolley contains on average 20 items and may contain up to around 40 items. In a retail store, such as a grocery supermarket, these items take a wide range of sizes, shapes and weights. Some items may be light and delicate (e.g. eggs), and others may be dense and heavy (e.g. canned goods). However, the terminal is still capable of handling and delivering each of these items carefully, even when such a large volume of items are to be processed together. Further, the terminal is arranged to be easily navigated by a user having a trolley or other large carrier, as illustrated particularly in FIG. 2 or FIG. 5.

Conveniently, the example terminal 100 allows the customer to progress through the checkout process with a loading operation at the loading position and then performing both a packing operation and a payment operation together at the packing position. Customers find the checkout terminal easier to use when packing occurs prior to payment and when payment occurs at the same position as packing. Hence, the example terminal is constructed with customer convenience and satisfaction in mind.

Figure 7:
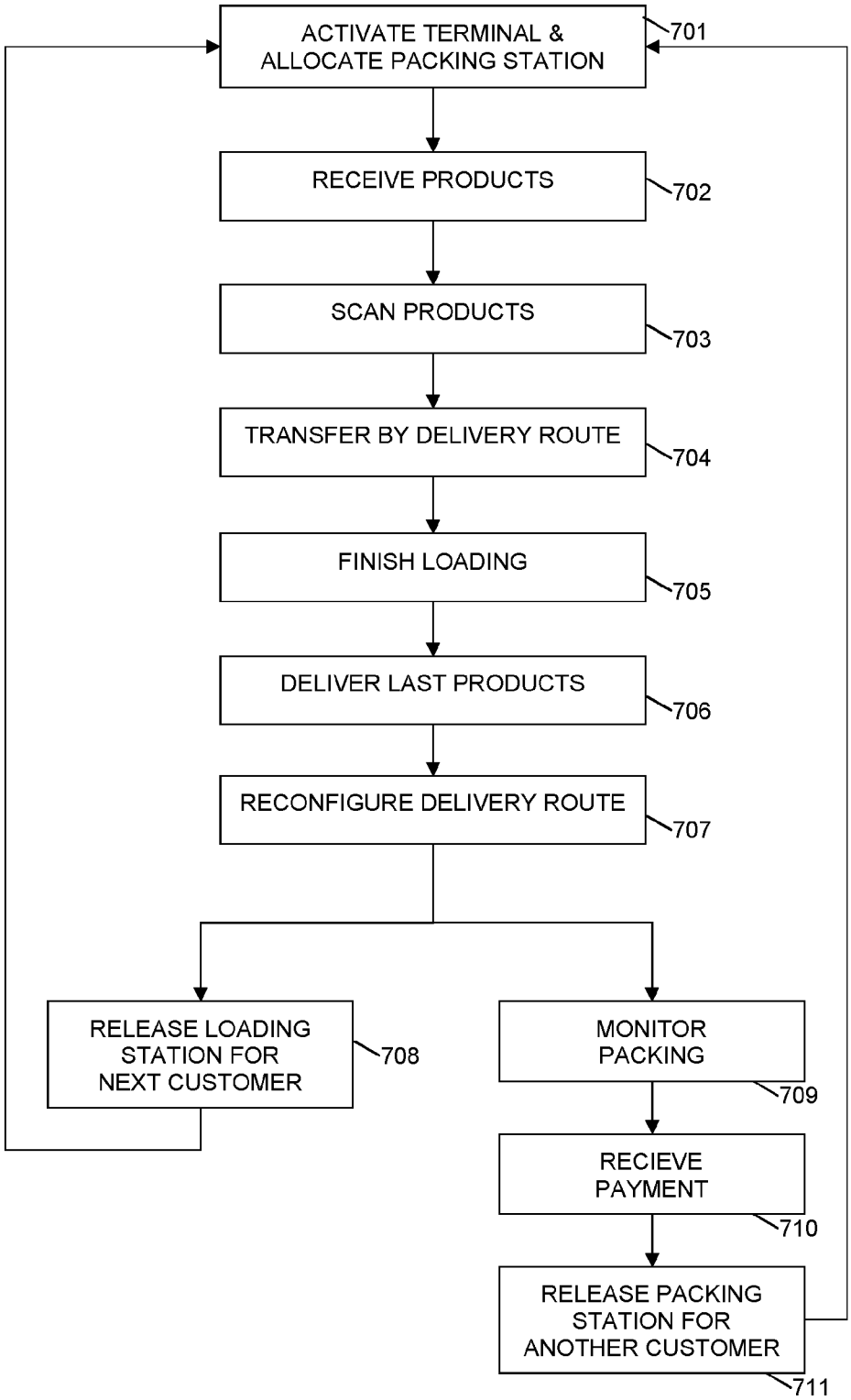
FIG. 7 is a schematic flowchart of an example method of operating a checkout terminal.

FIG. 7 is a schematic flowchart of an example method of operating a checkout terminal of the type described herein. As described in more detail above, the method may comprise the step 701 of activating the terminal 100 to be used by a customer. In one example, the step 701 comprises receiving an activation signal, which is input by the customer, conveniently by using the user interface 112 shown in FIG. 1. In another example, activation may be caused by the user placing a product onto the loading conveyor 110. The step 701 may also include selecting a vacant packing station to be used by the customer. The step 701 may also include informing the customer of the selected packing station. In one example, informing the customer comprises displaying a message on the user interface 112. In another example, informing the customer may comprise providing an indicator (e.g. a coloured light) which directs the customer toward the allocated packing station.

In one example, Step 702 may comprise receiving one or more products which are loaded onto the checkout terminal by the customer. The step 702 may include receiving the products onto the loading conveyor section 110 as discussed herein.

In one example, Step 703 may comprise scanning the products. The step 703 may comprise propelling the products through a scanner 121, suitably by using the loading conveyor 110.

In one example, Step 704 may comprise configuring a product diversion mechanism 160 to construct a product diversion route which reaches the selected packing station 140. The route may extend from the loading conveyor 100, via the scanner 121, along a transfer conveyor 130 to the selected packing station 140. The step 704 may include starting to transfer the products along the route toward the selected packing station. The product diversion route is suitably generally U-shaped when the checkout terminal 100 is viewed from above in a plan view.

In one example, Step 705 may comprise detecting that loading of the products is finished. The step 705 may include receiving a user input via the user interface 112 to confirm that loading of the products is finished. In another example, finishing may be determined by a time delay between consecutive products which exceeds a predetermined delay. In another example, finishing may be determined by detecting or scanning an identifier object, such as a divider.

In one example, Step 706 may comprise delivering the products of the customer to the selected packing station 140A until all of the loaded products have been transferred. The step 706 may include monitoring the transfer of the products to the packing station. Meanwhile, the step 706 may include monitoring that the customer transfers from a loading position to a packing position adjacent the selected packing station 140.

In one example, Step 707 may comprise reconfiguring the product diversion mechanism 160A, 160B so that subsequent products of a next customer will be routed to another of the packing stations 140B.

In one example, Step 708 may include releasing the loading position to be used by the next customer.

In one example, Step 709 may comprise monitoring packing of the products by the customer in the selected packing station, until packing of the products is completed. This monitoring may take any suitable form as will be appreciated by those skilled in the art.

In one example, Step 710 may comprise receiving a payment from the customer, suitably via a payment interface 150 located at or nearby to the selected packing station 140. The step 710 may include validating that the payment matches the products packed by the customer.

In one example, Step 711 may comprise releasing the respective packing station 140 ready to be used by another customer.

In summary, the example embodiments have described an improved checkout terminal suitable for use in a retail store. In one example, the checkout terminal may be configured to be operated by customers as a self-checkout terminal. The industrial application of the example embodiments will be clear from the discussion herein.

Although the example embodiments have been described with reference to the steps, components, modules and units discussed herein, such functional features may be combined into fewer elements or separated into additional elements. Various combinations of optional features have been described herein, and it will be appreciated that described features may be combined in any suitable combination. In particular, the features of any one example embodiment may be combined with features of any other embodiment, as appropriate, except where such combinations are mutually exclusive. Throughout this specification, the term "comprising" or "comprises" may mean including the component(s) specified but is not intended to exclude the presence of other components.

At least some of the example embodiments described herein may be constructed, partially or wholly, using dedicated special-purpose hardware. Terms such as 'component', 'module' or 'unit' used herein may include, but are not limited to, a hardware device, such as circuitry in the form of discrete or integrated components, a Field Programmable Gate Array (FPGA) or Application Specific Integrated Circuit (ASIC), which performs certain tasks or provides the associated functionality. In some embodiments, the described elements may be configured to reside on a tangible, persistent, addressable storage medium and may be configured to execute on one or more processors. These functional elements may in some embodiments include, by way of example, components, such as software components, object-oriented software components, class components and task components, processes, functions, attributes, procedures, subroutines, segments of program code, drivers, firmware, microcode, circuitry, data, databases, data structures, tables, arrays, and variables.

Although a few example embodiments have been shown and described, it will be appreciated by those skilled in the art that various changes and modifications might be made without departing from the scope of the invention, as defined in the appended claims.

The invention claimed is:

1. A checkout terminal, comprising:

a loading conveyor section arranged to receive and convey product items which are loaded onto the loading conveyor section in use;

a scanner arranged to scan the product items conveyed by the loading conveyor section;

a transfer conveyor section oriented at an angle relative to the loading conveyer section and arranged to transfer the product items away from the loading conveyor section;

a plurality of packing stations each arranged to selectively receive product items from the transfer conveyor section according to a currently selected delivery path;

wherein the loading conveyor section, the transfer conveyor section and each of the plurality of packing stations are provided as a plurality of separate modular sections, and wherein the plurality of packing stations are arranged spaced apart from each other along a length of the transfer conveyor section and a gap is provided between at least one neighboring pair of the packing stations, wherein, the loading conveyer section is disposed on a first side of the transfer conveyer section and each of the plurality of packing stations are disposed on a second side of the transfer conveyer section, and wherein each of the packing stations has a different length measured in a direction away from the transfer conveyor section.

2. The checkout terminal of claim 1, wherein the packing stations are each releasably coupled to the transfer conveyor section.

3. The checkout terminal of claim 1, wherein the transfer conveyor section comprises a plurality of coupling positions and is configured to releasably receive the plurality of packing stations each at a respective one of the plurality of coupling positions along the transfer conveyor section.

4. The checkout terminal of claim 1, wherein the packing stations are arranged substantially parallel to each other and substantially perpendicular to the transfer conveyor section.

5. The checkout terminal of claim 1, wherein the packing stations are arranged in a row, each packing station being fed in common by the transfer conveyor section.

6. The checkout terminal of claim 1, wherein the loading conveyor section is releasably coupled to the transfer conveyor section and is arranged substantially perpendicular to the transfer conveyor section.

7. The checkout terminal of claim 1, further comprising a product diversion unit arranged to selectively divert the product items from the transfer conveyor section into a respective one of the plurality of packing stations.

8. The checkout terminal of claim 7, wherein the product diversion unit comprises at least one diverter arranged to selectively divert product items from the transfer conveyor section into the respective packing station according to a product diversion route set for the customer.

9. The checkout terminal of claim 8, wherein the diverter comprises an arm which is rotatably mounted to extend selectively in use across the transfer conveyor section.

10. The checkout terminal of claim 1, wherein the plurality of packing stations comprise at least first, second and third packing stations, and wherein the checkout terminal further comprises:

a first diverter configured to selectively divert products into the first packing station when the first packing station is allocated to the customer or else to allow the product items to continue along the transfer conveyor section, and a second diverter configured to selectively divert products into the second packing station when the second packing station is allocated to the customer or else to allow the product items to continue along the transfer conveyor section, and wherein the first and second diverters are configured to allow the product items to reach the third packing station along the transfer conveyor section when the third packing station is allocated to the customer.

11. The checkout terminal of claim 1, wherein at least one of the packing stations comprises a conveyor to propel the product items therealong.

12. The checkout terminal of claim 1, wherein the checkout terminal is arranged to allocate a currently vacant one of the packing sections to the customer upon receiving an activation signal from a user interface unit located adjacent to the loading conveyor section.

13. The checkout terminal of claim 12, wherein the checkout terminal is arranged to allocate the loading section to the customer until the checkout terminal determines that loading of product items is finished, and then to release the loading section for use by another customer.

14. The checkout terminal of claim 13, wherein the checkout terminal is arranged to release the currently allocated packing section after receiving a payment from the customer for the product items.

15. The checkout terminal of claim 1, further comprising a trolley parking guide associated with each of the packing stations, the trolley parking guide defining a parking position for a trolley to rest adjacent to the respective packing station.

16. A checkout terminal, comprising:

a loading conveyor section arranged to receive and convey product items which are loaded onto the loading conveyor section in use;

a scanner arranged to scan the product items conveyed by the loading conveyor section;

a transfer conveyor section arranged to transfer the product items away from the loading conveyor section; and a plurality of packing stations each arranged to selectively receive product items from the transfer conveyor section according to a currently selected delivery path;

wherein the loading conveyor section, the transfer conveyor section and the plurality of packing stations are provided as a plurality of separate modular sections, wherein each packing station of the plurality of packing stations is associated with a corresponding and separate payment interface located at or near to the respective packing station, and wherein the plurality of packing stations are arranged spaced apart from each other along a length of the transfer conveyor section and a gap is provided between at least one neighboring pair of the packing stations, wherein, the loading conveyer section is disposed on a first side of the transfer conveyer section and each of the plurality of packing stations are disposed on a second side of the transfer conveyer section, and wherein each of the packing stations has a different length measured in a direction away from the transfer conveyor section.

17. A method of operating a checkout terminal, comprising:

activating the terminal ready to be used by a current customer;

configuring a product diversion mechanism to construct a product diversion route which reaches a selected one of a plurality of packing stations from a loading conveyor section via a transfer conveyor section oriented at an angle relative to the loading conveyer section;

receiving one or more products which are loaded onto the checkout terminal by the customer;

scanning the products by a scanner located on the product diversion route;

moving the products of the customer along the product diversion route until all of the loaded products have been transferred to the selected packing station;

completing, via a payment interface, a payment for the products; and reconfiguring the product diversion mechanism so that subsequent products of a next customer are routed to another of the plurality of packing stations, wherein the plurality of packing stations are arranged spaced apart from each other along a length of the transfer conveyor section and a gap is provided between at least one neighboring pair of the packing stations, wherein, the loading conveyer section is disposed on a first side of the transfer conveyer section and each of the plurality of packing stations are disposed on a second side of the transfer conveyer section, and wherein each of the packing stations has a different length measured in a direction away from the transfer conveyor section.

18. The method of claim 17, further comprising releasing the loading conveyor section of the checkout terminal to be used by the next customer, after the product items of the current customer have left the loading conveyor section.

19. The method of claim 18, further comprising monitoring packing of the products by the customer in the selected packing station, until packing of the products is completed, and then releasing the packing station ready to be used by another customer.

20. The method of claim 17, wherein configuring the product diversion mechanism comprises constructing the product diversion route substantially in a U-shape or in an S-shape when the checkout terminal is viewed from above in a plan view.

* * * * *